United States Patent [19]

Routery

[11] Patent Number: 4,462,345

[45] Date of Patent: Jul. 31, 1984

[54] ENERGY TRANSFER DEVICE UTILIZING DRIVESHAFT HAVING CONTINUOUSLY VARIABLE INCLINED TRACK

[75] Inventor: Edward E. Routery, Yuma, Ariz.

[73] Assignee: Pulsar Corporation, Phoenix, Ariz.

[21] Appl. No.: 283,072

[22] Filed: Jul. 13, 1981

[51] Int. Cl.[3] ..... F02B 75/32

[52] U.S. Cl. ..... 123/58 C; 123/197 AC; 123/46 E; 74/127

[58] Field of Search ..... 123/61 R, 63, 58 R, 123/58 A, 58 C, 197 R, 197 C, 197 AC, 197 AB, 1 R, 46 E, 46 R; 74/57, 58, 127, 128

[56] References Cited

U.S. PATENT DOCUMENTS

| | | | |
|---|---|---|---|
| 465,099 | 12/1891 | Rice | 92/151 |
| 1,243,554 | 10/1917 | Rasmussen | 123/58 C |
| 2,447,314 | 8/1948 | Carroll | 123/58 C |
| 3,449,968 | 6/1969 | Gerard et al. | 74/57 |
| 3,786,790 | 1/1974 | Plevyak | 123/58 C |
| 3,916,866 | 11/1975 | Rossi | 123/197 AC |
| 4,213,428 | 7/1980 | Bradley | 123/46 E |

FOREIGN PATENT DOCUMENTS

| | | | |
|---|---|---|---|
| 424867 | 2/1926 | Fed. Rep. of Germany | 123/58 C |

OTHER PUBLICATIONS

Emmelor, "Rescan Drive for Moving Platen or Optics Carriage", Xerox Disclosure Journal; vol. 4, No. 6, p. 793, Dec. 1979.

*Primary Examiner*—Craig R. Feinberg

*Attorney, Agent, or Firm*—Cullen, Sloman, Cantor, Grauer, Scott & Rutherford

[57] ABSTRACT

An energy transfer device includes a rotatable driveshaft supported within a cylinder and including first and second pistons slidably mounted within the cylinder. The driveshaft has first and second generally helical tracks formed thereupon and extending in opposite rotational directions about the driveshaft. First and second ratcheted cam clutches are coupled to the first and second pistons, respectively, and engage the first and second tracks within the driveshaft for converting reciprocating sliding motion of the first and second pistons into rotational motion of the driveshaft. The first and second pistons may be reciprocated by a valving mechanism which alternately admits pressurized fluidto one end portion of the cylinder while exhausting fluid from the opposite end portion thereof. The first and second pistons may also be reciprocated by magnetizing the first and second pistons and surrounding the cylinder by an alternating electromagnetic field.

14 Claims, 9 Drawing Figures

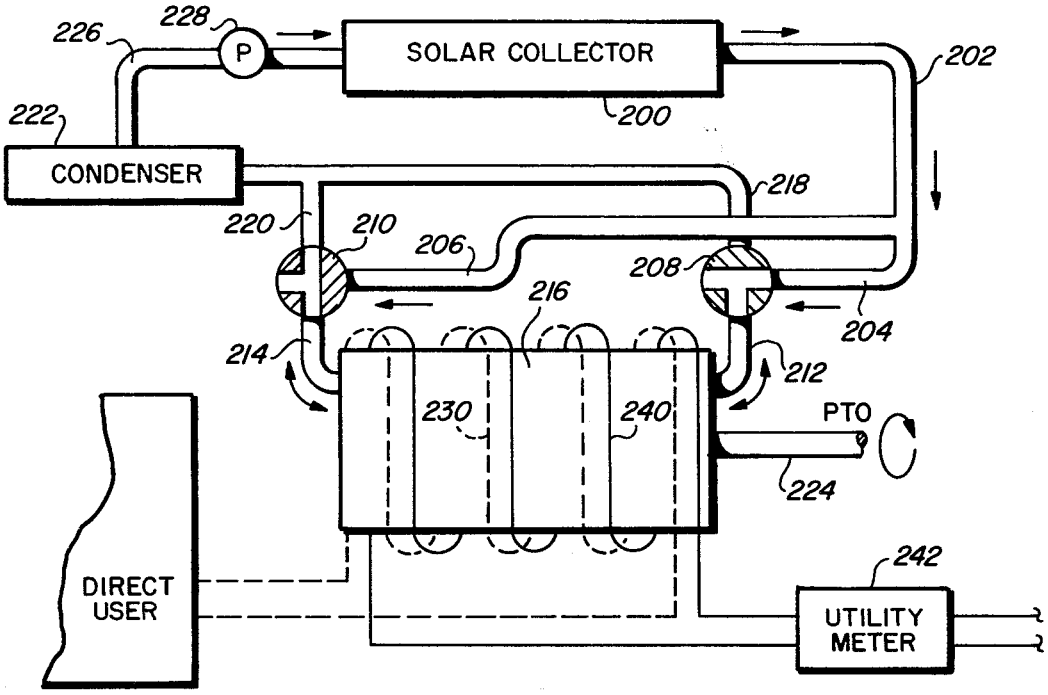
FIG. 8
FIG. 9
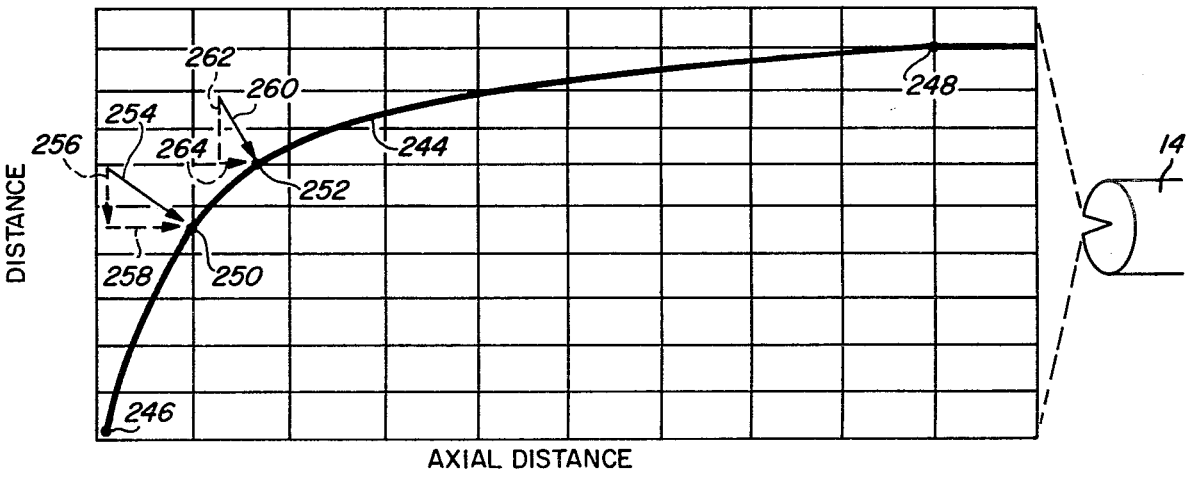

ENERGY TRANSFER DEVICE UTILIZING DRIVESHAFT HAVING CONTINUOUSLY VARIABLE INCLINED TRACK

BACKGROUND OF THE INVENTION

The present invention relates generally to energy transfer devices such as engines and motors, and more particularly, to an engine having a cylinder, a driveshaft rotatably supported within the cylinder, and at least one piston slidably mounted within the cylinder wherein the driveshaft includes a generally helical track formed thereon and including a ratcheted clutch coupled to the piston and engaging the helical track for converting reciprocal motion of the piston to rotational motion of the driveshaft.

DESCRIPTION OF THE PRIOR ART

Engines which convert the reciprocal motion of one or more pistons into rotational motion of a driveshaft are well known in the art. Such prior art engines typically include one or more cylinders within which a piston is slidably mounted for reciprocal movement, a crankshaft having an axis of rotation generally perpendicular to the longitudinal axis of each cylinder, and connecting rods pivotally connected to each piston and to the crankshaft for converting the linear movement of each piston to a rotational cranking force for rotating the crankshaft. Each piston is typically powered by a non-combustible pressurized fluid such as pressurized air or, in the case of an internal combustion engine, by a combustible mixture which is ignited within the cylinder. In either case, the torque provided to the crankshaft as the piston advances varies widely for at least two reasons. First, the force applied to each piston by the pressurized fluid or the ignited combustion gases tend to decrease as the piston is displaced and the volume of the expansion chamber formed by the cylinder and the piston head increases. Secondly, the force coupled to the crankshaft by the advancing pistons varies according to the angular position of the connecting rod relative to the crankshaft. Due to the variations in torque provided by each piston, it is common practice to affix a flywheel to the crankshaft for the purpose of damping out variations in torque provided thereto.

Moreover, conventional reciprocating piston engines are inefficient energy transfer devices because the pressure within each cylinder must be relatively high near the bottom of the piston stroke in order to apply a significant cranking force to the crankshaft at that time; yet, the relatively high pressure within the cylinder when the piston has reached the bottom of its stroke is subsequently exhausted in order to avoid opposing the return of the piston to its uppermost position within the cylinder. The relatively high pressure exhausted from the cylinder represents energy which cannot be utilized to rotate the crankshaft and is essentially wasted.

The rotational speed of conventional piston driven engines may easily be regulated by merely controlling the flow rate of combustible fluid or by controlling the pressure of pressurized fluid admitted into the cylinder. However, when it is desired to adjust the torque provided by such an engine, it is almost always necessary to make such an adjustment by interposing a transmission between the engine and the load being driven by the engine. The addition of such a transmission obviously renders the resulting drive system more complex and more expensive.

Accordingly, it is an object of the present invention to provide an energy transfer device for efficiently converting reciprocal motion to rotational motion while allowing the resulting torque to be easily adjusted.

It is another object of the present invention to provide an engine for efficiently converting the reciprocating movement of a piston into rotational motion of a driveshaft.

It is still another object of the present invention to provide an engine for converting reciprocating motion of one or more pistons to rotational motion of a driveshaft wherein a substantially constant torque may be provided to the driveshaft, virtually eliminating the need for a flywheel or other torque-variation damping mechanism.

It is yet another object of the present invention to provide such an engine wherein the speed and torque imparted to the driveshaft are each easily adjustable.

It is a further object of the present invention to provide such an engine wherein the piston can be reciprocated either by combustion gases produced by the ignition of a combustible mixture within the cylinder or by the introduction of a pressurized fluid within the cylinder.

It is still a further object of the present invention to provide such an engine wherein the piston may be reciprocated by electro-magnetic forces.

These and other objects of the present invention will become more apparent to those skilled in the art as the description thereof proceeds.

SUMMARY OF THE INVENTION

Briefly described, and in accordance with one embodiment thereof, the present invention relates to an energy transfer device for converting reciprocal motion of at least one piston or similar driving member to rotational motion of a driveshaft, the energy transfer device including a cylinder having a longitudinal axis, a rotatable driveshaft having a longitudinal axis parallel to the longitudinal axis of the cylinder, and at least one piston slidably mounted within the cylinder. The energy transfer device further includes a cam mechanism coupled to the piston for converting sliding movement of the piston into unidirectional rotational motion of the driveshaft. In one embodiment of the invention, the driveshaft is rotatably supported within the cylinder with the longitudinal axis of the driveshaft coincident with the longitudinal axis of the cylinder.

The cam mechanism preferably includes a ratched cam clutch secured to the piston and having a follower for engaging a generally helical track formed upon the driveshaft. The ratched cam clutch allows the follower to rotate about the longitudinal axis of the driveshaft relative to the first piston in a first direction only. During the power stroke of the piston, the angular position of the follower is essentially locked relative to the piston whereby sliding movement of the piston applies a twisting force upon the driveshaft via the follower and helical track.

In one embodiment of the present invention, the generally helical track has a continuously varying incline, i.e., the ratio of the angle of rotation about the longitudinal axis of the driveshaft relative to the corresponding displacement in the axial direction continuously varies from one end of the track to the other. The rate at which the angle of incline of the track varies may be matched to variations in the force applied to the piston as the piston advances during its power stroke for applying substantially constant torque to the driveshaft throughout the entire power stroke of the piston.

In a preferred form of the invention, the cylinder has first and second ends, and first and second pistons are slidably mounted within the cylinder proximate the first and second ends thereof. First and second helical tracks are formed upon the driveshaft and rotate in opposite directions relative to one another. First and second ratched cam clutches are secured to the first and second pistons and include first and second followers for engaging the first and second helical tracks, respectively. The first ratched cam clutch allows rotational movement of the first follower only in one rotational direction relative to the first piston, and the second ratched cam clutch similarly allows rotational movement of the second follower only in one rotational direction.

In order to reciprocate the first and second pistons, a valving mechanism is provided at each end of the cylinder for alternately admitting a fluid thereto or exhausting a fluid therefrom. The fluid admitted may be either a combustible fuel mixture that is subsequently ignited within the end portions of the cylinder or a pressurized fluid. Timing of the valve mechanism provided at each end of the cylinder is effected either by sensing the angular position of the driveshaft or by sensing the axial position of the pistons.

In another form of the present invention, the piston or pistons are magnetized either permanently or electromagnetically, and the cylinder is surrounded by an electrical coil for conducting an alternating current. The resulting electro-magnetic field created by the electrical coil causes the piston or pistons to reciprocate within the cylinder, and the energy transfer device converts the resulting reciprocating motion of the magnetized piston or pistons into rotational motion of the driveshaft.

BRIEF DESCRIPTION OF THE DRAWINGS

FIG. 8 is a block diagram of a solar powered apparatus utilizing an engine of the general type shown in FIG. 1, and also showing the manner in which the engine may be integrated with the user's utility connection for alternately deriving power from or supplying electrical power to the user's electrical system.

FIG. 9 illustrates the outer surface of the drive shaft when unrolled into a plane for the purpose of illustrating the manner in which the angle of incline of a generally helical track varies from one end of the track to the other.

DETAILED DESCRIPTION OF THE PREFERRED EMBODIMENT

Figure 1:
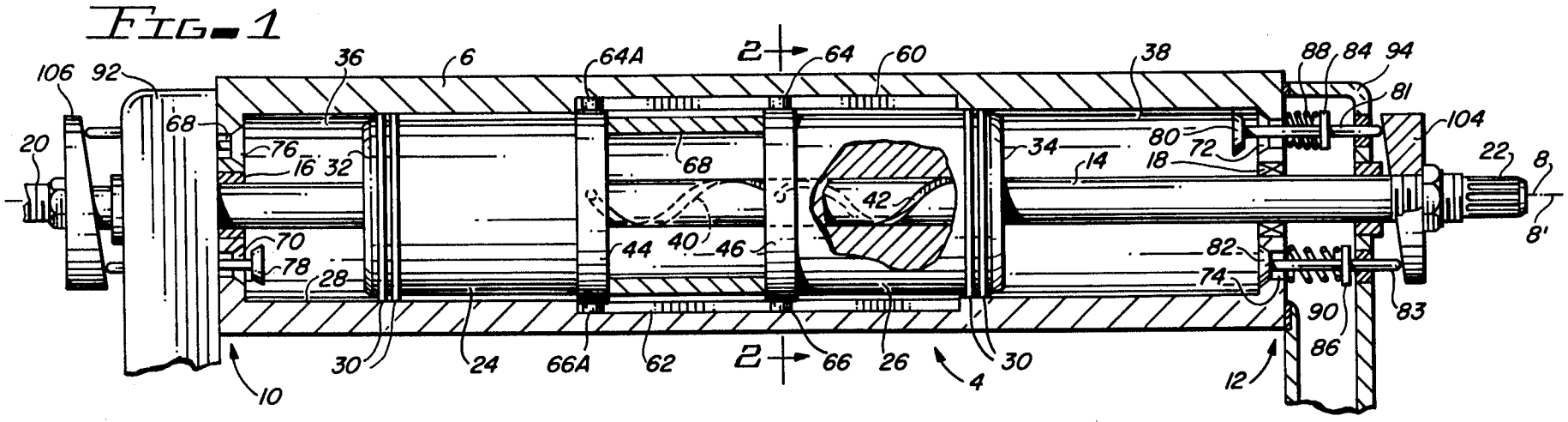
FIG. 1 is a cross sectional view of one embodiment of an engine constructed according to the teachings of the present invention.
Figure 2:
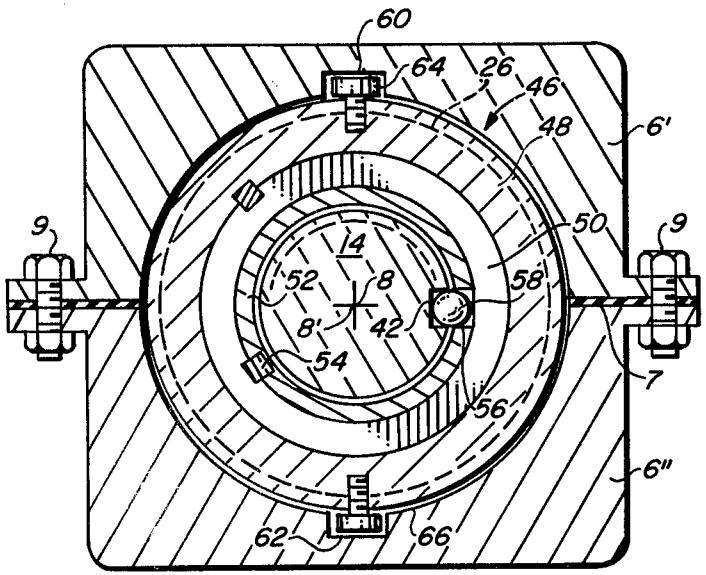
FIG. 2 is a cross sectional view taken through lines 2—2 as shown in FIG. 1.

In FIG. 1, an engine, designated generally by reference numeral 4, illustrates one embodiment of the present invention. Engine 4 includes an elongated cylinder 6 having a longitudinal axis 8. Referring briefly to FIG. 2, cylinder 6 may be constructed from two semicylindrical halves 6' and 6'' joined by a gasket 7 and bolts 9. Cylinder 6 has first and second opposing closed ends 10 and 12. A driveshaft 14 extends through cylinder 6 parallel to longitudinal axis 8 and is rotatably supported therein by bearing surfaces 16 and 18 formed within end walls 10 and 12, respectively, of cylinder 6. Opposing ends 20 and 22 of driveshaft 14 are preferably splined to facilitate the coupling of a load to driveshaft 14. In the preferred embodiment of the present invention, the longitudinal axis 8' of driveshaft 14 is coincident with longitudinal axis 8 of cylinder 6.

Still referring to FIG. 1, first and second pistons 24 and 26 are slidably mounted within cylinder 6 for reciprocal movement therein along the direction of longitudinal axis 8. The outer diameters of pistons 24 and 26 are each commensurate with the diameter of inner wall 28 of cylinder 6, and compression rings 30 are seated within annular grooves formed within pistons 24 and 26 in a conventional manner for sealingly engaging inner wall 28 of cylinder 6. Pistons 24 and 26 include piston heads 32 and 34 which face end walls 10 and 12, respectively. First and second expansion chambers 36 and 38 are formed within cylinder 6 between end walls 10 and 12 and piston heads 32 and 34, respectively.

Within the embodiment of the invention shown in FIG. 1, driveshaft 14 extends through piston heads 32 and 34 of pistons 24 and 26, respectively. Accordingly, holes are formed within piston heads 32 and 34 for allowing driveshaft 14 to pass therethrough. The holes formed within piston heads 32 and 34 comprise bearing surfaces which allow pistons 24 and 26 to slide with respect to driveshaft 14 and which allow driveshaft 14 to rotate with respect to pistons 24 and 26. Such bearing surfaces preferably include a seal for wipingly engaging driveshaft 14 to avoid a loss of compression within expansion chambers 36 and 38.

In order to convert the reciprocal sliding motion of pistons 24 and 26 into rotational motion of driveshaft 14, first and second generally helical tracks 40 and 42 are formed upon the outer surface of driveshaft 14 proximate the central portion thereof. As shown more clearly in FIG. 2, guide tracks 40 and 42 are in the form of rectangular slots or grooves cut within driveshaft 14. However, it will be apparent to those skilled in the art that guide tracks 40 and 42 may also be in the form of generally helical ridges or rails which project radially outward from driveshaft 14. As shown in FIG. 1, pistons 24 and 26 are coupled to ratcheted cam clutches 44 and 46. Ratcheted cam clutches 44 and 46 cooperate with tracks 40 and 42 in order to convert the reciprocal movement of pistons 24 and 26 into unidirectional rotational movement of driveshaft 14 in a manner to be explained below.

Referring now to FIG. 2, ratcheted cam clutch 46 includes an outer race 48 and an inner race 50. Inner race 50 freely rotates within outer race 48 in a single direction only but is prevented from rotating in the opposite direction. Such ratcheted cam clutches are commercially available from Morse Chain Division of Borg-Warner Corporation, Ithaca, N.Y. under Model Designation Nos. B203-B210 and PB3-PB14. Secured within inner race 50 is a sleeve 52 which is locked against rotation relative to inner race 50 by key 54. A rectangular shaped pocket 56 is formed within the inner wall of sleeve 52 having a width commensurate with the width of guide track 42 formed within driveshaft 14. A cam follower, represented by ball bearing 58 in FIG. 2, rides within pocket 56 of sleeve 52 and slides within guide track 42 of driveshaft 14 for effecting a coupling therebetween. Although not illustrated, ratcheted cam clutch 44 is of similar construction and includes an identical cam follower or ball which rides within guide track 40.

In order to prevent rotational motion of piston 26 and its associated outer race 48, a pair of linear, rectangularly shaped slots 60 and 62 are formed within cylinder sections 6' and 6" extending parallel to the longitudinal axis of cylinder 6. Cam followers 64 and 66 are secured to outer race 50for sliding movement within linear slots 60 and 62, respectively. Cam followers 64 and 66 allow piston 26 and outer race 48 to freely reciprocate while preventing rotational motion thereof. Similarly, first and second cam followers 64A and 66A (see FIG. 1) extend from the outer race of ratcheted cam clutch 44 for sliding movement within linear slots 60 and 62, respectively, for preventing rotational motion of piston 24 and the outer race of ratcheted cam clutch 44.

The outer races of ratcheted cam clutches 44 and 46 are secured to each other by a sleeve 68 (shown in cross section in FIG. 1) in order to maintain pistons 24 and 26 in spaced apart relationship by a fixed distance. Sleeve 68 insures that pistons 24 and 26 reciprocate as a unit. Thus, during the power stroke of piston 24, sleeve 68 pushes piston 26 toward end wall 12 in preparation for the subsequent power stroke of piston 26.

Figure 3:
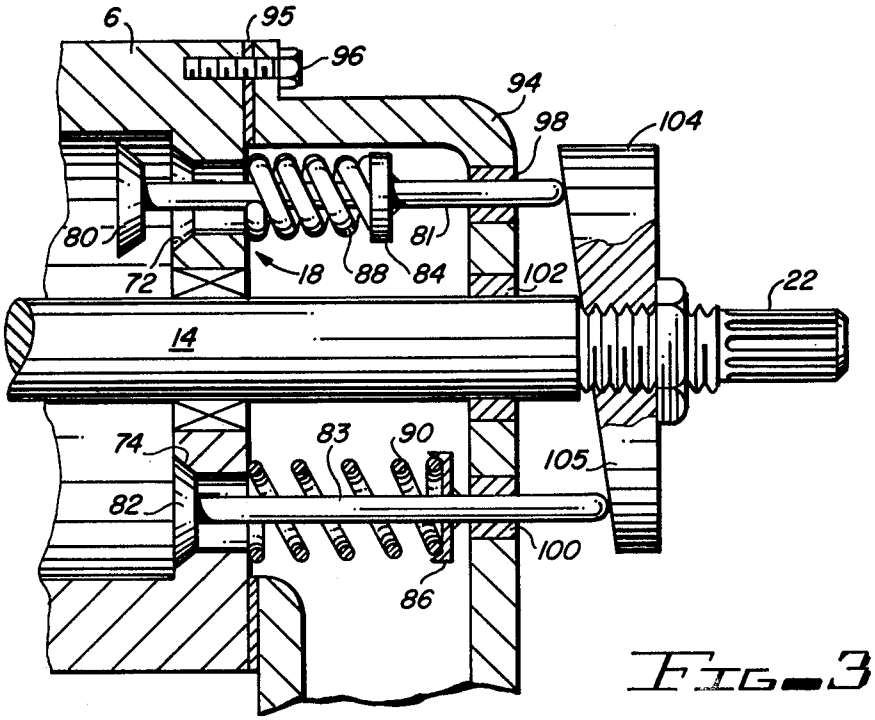
FIG. 3 is a detailed cross sectional view of a valve mechanism controlled by the angular position of the driveshaft.

Reciprocation of pistons 24 and 26 may be effected either by internal combustion of a combustible fuel mixture or by suitable application of a pressurized fluid within expansion chambers 36 and 38. A mechanical valving mechanism which can be used to introduce and exhaust the combustible fuel mixture or pressurized fluid to and from expansion chambers 36 and 38 is shown in FIG. 1. Within end walls 10 and 12 are formed valve openings 68, 70, 72, and 74 against which valve heads 76, 78, 80, and 82 may be sealingly engaged, respectively. As shown in FIGS. 1 and 3, valve heads 80 and 82 are secured to one end of valve stems 81 and 83, respectively, which extend through valve openings 72 and 74 and beyond end wall 12. Upon the portion of each valve stem extending outwardly beyond end walls cylinder 6 is secured a shoulder, such as shoulders 84 and 86 (see FIG. 3), and compression springs such as 88 and 90 are disposed between end wall 12 and shoulders 84 and 86 for urging valve heads 80 and 82 against their respective valve seats for sealing expansion chamber 38.

Overlying end walls 10 and 12 of cylinder 6 are inlet and outlet manifold assemblies 92 and 94. As shown by the enlarged view of FIG. 3, a sealing gasket 95 is inserted between manifold cover 94 and end wall 18 of cylinder 6, and bolts such as 96 are used to secure manifold cover 94 thereto. Manifold cover 94 incorporates first and second apertured bearing surfaces 98 and 100 through which extend the ends of valve stems 81 and 83 opposite valve heads 80 and 82. Bearing surfaces 98 and 100 further include a seal which wipingly engages valve stems 81 and 83 for preventing the passage of pressurized fluids through bearing surfaces 98 and 100. In addition, manifold cover 94 includes a larger bearing surface 102 through which driveshaft 14 extends. For purposes of simplification, the drawings omit a dividing wall which separates the portion of manifold 94 surrounding valve stem 81 from the portion surrounding valve stem 83. The portion of manifold 94 surrounding valve stem 81 is coupled to an outlet for exhausting fluid within expansion chamber 38 to an area of relatively low pressure. On the other hand, the portion of manifold 94 surrounding valve stem 83 is coupled to a source of a combustible gas mixture or a pressurized fluid. Similarly, within manifold 92, valve opening 68 is in fluid communication with an exhaust outlet for exhausting fluid from expansion chamber 36, while valve opening 70 is in fluid communication with the source of combustible fuel mixture or the source of high pressure fluid.

In one embodiment of the present invention, the timing mechanism used to control the operation of the inlet and outlet valves (76, 78, 80, and 82) is responsive to the angular position of driveshaft 14. As shown in FIGS. 1 and 3, a wobble plate 104 is rigidly secured, as by threaded engagement, to driveshaft 14 for interaction with the ends of valve stems 81 and 83. Wobble plate 104 includes an angled camming surface 105 which periodically and alternately forces valve stems 81 and 83 to move inwardly toward expansion chamber 38 against the biasing force of springs 88 and 90 to unseat valve heads 80 and 82. An identical wobble plate 106 is secured to the opposite end of driveshaft 14 for periodically unseating valve heads 76 and 78. Wobble plate 106 also includes an angled camming surface rotated 180° with respect to camming surface 105 of wobble plate 104.

Within the embodiment of the invention shown in FIG. 1, it is assumed that a pressurized fluid, such as compressed air or hydraulic oil is used to reciprocate pistons 24 and 26. Were a combustible fuel mixture utilized, a spark plug (not shown) or other means for igniting the combustible mixture within expansion chambers 36 and 38 could be provided. As shown in FIG. 1, when pistons 24 and 26 are closest to end wall 10, inlet valve head 78 is unseated by wobble plate 106 to allow pressurized fluid to fill expansion chamber 36 in order to force pistons 24 and 26 toward end wall 12. Simultaneously, wobble plate 104 unseats valve head 80 for exhausting fluid from expansion chamber 38, thereby avoiding any opposition to the movement of piston head 34 toward end wall 12. As piston 24 advances toward end wall 18, ratcheted cam clutch 44 pushes its cam follower against track 40 within driveshaft 14 for causing driveshaft 14 to rotate in a counter clockwise direction with respect to FIG. 2. During this power stroke of piston 24, ratcheted cam clutch 46 is in a free wheeling condition wherein inner race 50 may rotate freely with respect to outer race 48; accordingly, ratcheted cam clutch 46 and piston 26 are effectively unlocked from driveshaft 14 and freely slide toward end wall 12. On the other hand, when pistons 24 and 26 have fully advanced toward end wall 12, wobble plate 104 has rotated by 180° from the position shown in FIG. 1, and inlet valve head 82 is unseated for pressurizing expansion chamber 38 while outlet valve head 80 is seated. Similarly, wobble plate 106 also has rotated by 180° from the position shown in FIG. 1, whereby inlet valve head 78 is fully seated while exhaust valve head 76 is unseated. Thus, pistons 24 and 26 are then forced toward end wall 10. During this power stroke of piston 26, inner race 50 is locked with respect to outer race 48, and cam follower 58 pushes against track 42 for applying a force to driveshaft 14 which again causes it to rotate in a counter clockwise direction with respect to FIG. 2. As piston 24 advances toward end wall 10, ratcheted cam clutch 44 is in its free wheeling condition and is effectively unlocked from driveshaft 14. Accordingly, piston 24 and ratcheted cam clutch 44 are allowed to freely slide toward end wall 10. The above described reciprocation cycle may be repeated indefinitely.

Figure 4:
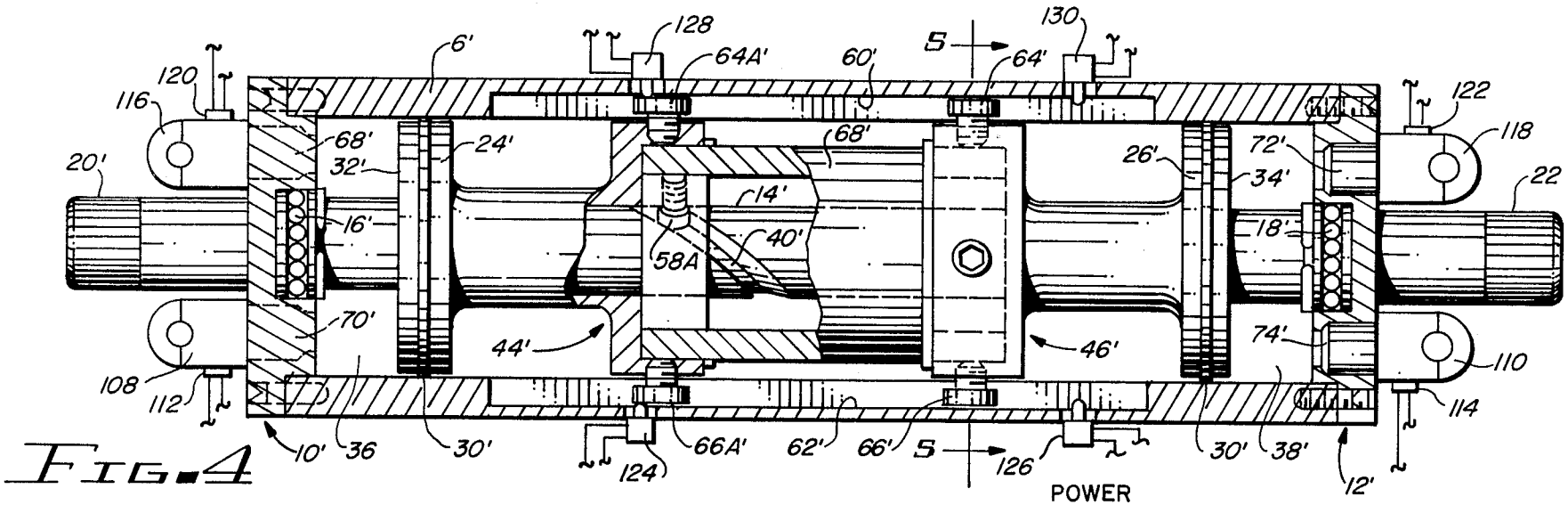
FIG. 4 is a cross sectional view of an alternate embodiment of the engine shown in FIG. 1 wherein switches are provided for directly sensing the position of the pistons within the cylinder in order to control the inlet and exhaust valves.
Figure 5:
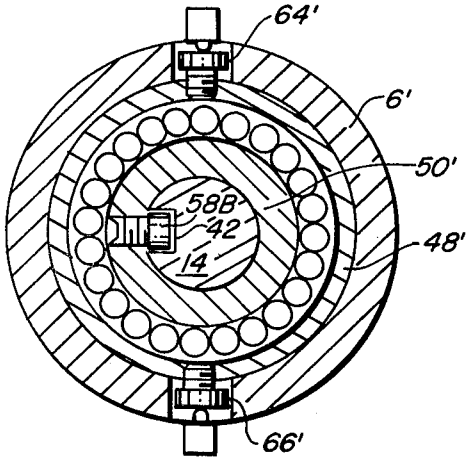
FIG. 5 is a cross sectional view taken through lines 5—5 as shown in FIG. 4.
Figure 6:
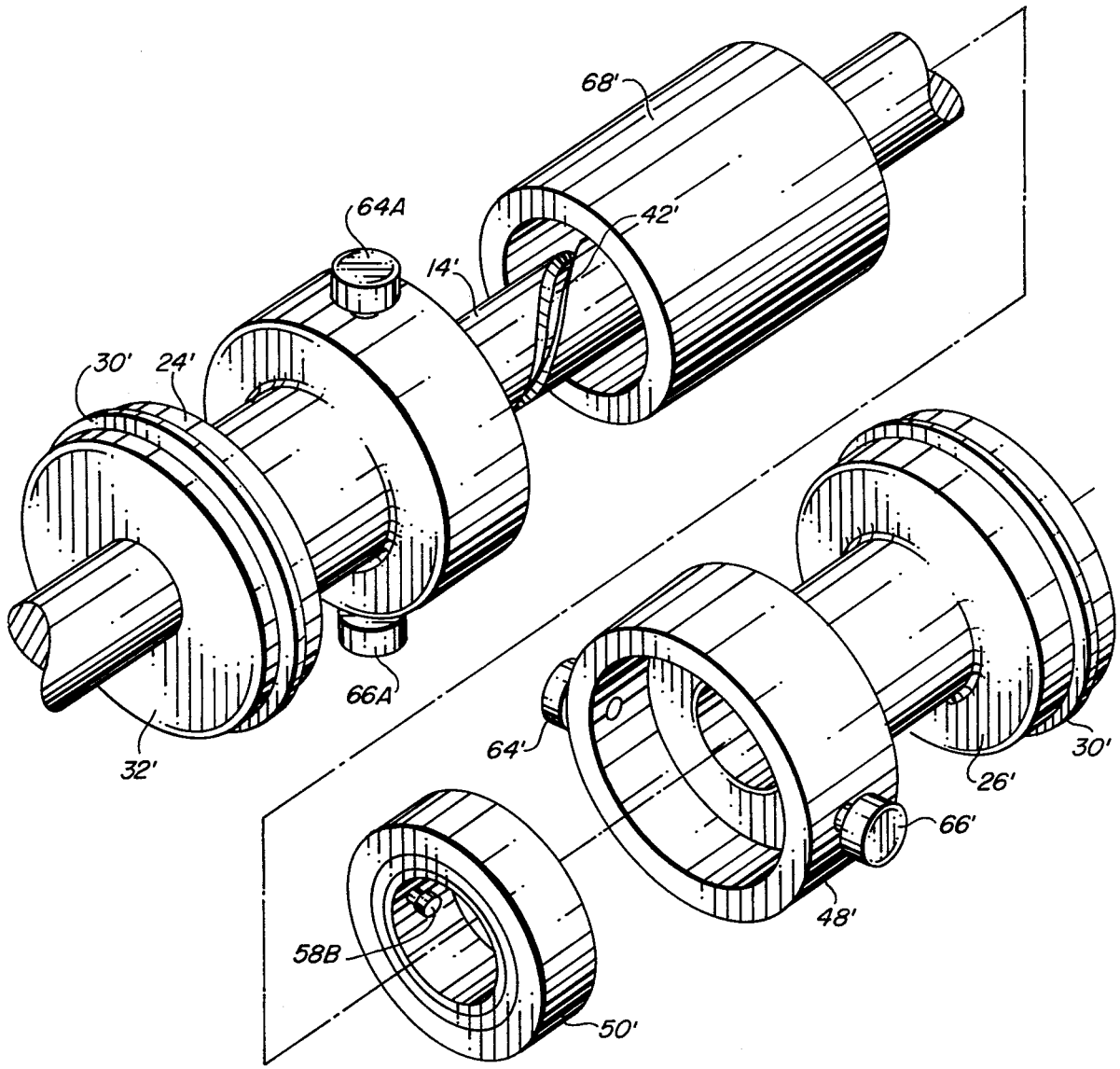
FIG. 6 is a perspective view of the pistons, driveshaft, and ratched cam clutches shown in FIG. 4.

Referring to FIGS. 4–6, an alternate embodiment of the present invention is illustrated wherein components corresponding to those previously described with regard to FIGS. 1–3 have been designated by like primed reference numerals. 1 As before, pistons 24' and 26' reciprocate as a unit within cylinder 6'. Pistons 24' and 26' are coupled to ratcheted cam clutch mechanisms 44' and 46' which engage guide tracks 40' and 42' via roller followers 58A and 58B. Unlike the ball bearing cam follower 58 shown in FIG. 2, roller followers 58A and 58B include rollers which rotatably engage the side walls of slotted guide tracks 40' and 42', respectively. As shown in FIG. 6, piston 26' and the outer race 48' of ratcheted cam clutch 46' have been rotated 90° from their positions shown in FIG. 4 in order to more clearly illustrate the features of outer race 48.

As shown in FIG. 4, the first and second ends of cylinder 6' are closed by end walls 10' and 12'. As in the case of the embodiment illustrated in FIGS. 1–3, end walls 10' and 12' include inlet and outlet valve openings 68', 70', 72', and 74', respectively, for allowing a fluid to enter into and be exhausted from expansion chambers 36' and 38'. However, rather than controlling the valve openings with spring-biased, cam operated valves as in the embodiment of the invention described with reference to FIGS. 1–3, electrically operated solenoid valves are used to control the timing of fluid entry and exhaust into and from expansion chambers 36' and 38'. Accordingly, inlet valves 70' and 74' are coupled to inlet manifolds 108 and 110, and electrically operated solenoid valves 112 and 114 selectively allow fluid to enter into expansion chambers 36' and 38' from inlet manifolds 108 and 110, respectively. Similarly, outlet valve openings 68' and 72' are coupled to outlet manifolds 116 and 118, respectively, and electrically operated solenoid valves 120 and 122 selectively allow the passage of fluid from expansion chambers 36' and 38' through valve openings 68' and 72' to exhaust manifolds 116 and 118, respectively.

Within the embodiment of the invention illustrated in FIG. 4, the timing of fluid entry into and exhaust from expansion chambers 36' and 38' is controlled according to the axial position of pistons 24' and 26' rather than according to the angular position of driveshaft 14'. Since ratcheted cam clutches 44' and 46' each allow their associated inner races to free wheel relative to their outer races in one rotational direction, it is possible in some instances for driveshaft 14' to become effectively unlocked and independent from pistons 24' and 26' as for example, when driveshaft 14' rotates faster than the rate at which pistons 24' and 26' reciprocate. In such instances, the angular position of the driveshaft becomes unrelated to the axial position of pistons 24' and 26'; hence, timing the opening and closing of the various valves according to the angular position of the driveshaft, as by the use of wobble plates 104 and 106 shown in FIG. 1, can be disadvantageous in such instances. Accordingly, another aspect of the present invention relates to sensing the axial position of pistons 24' and 26' in order to properly control the operation of electrically operated solenoid valves 112, 114, 120, and 122. To this end, microswitches 124 and 126 are mounted upon cylinder 6' with their depressible actuator levers extending into slotted track 62' in interfering relationship with cam followers 66A' and 66', respectively. Similarly, a second pair of microswitches 128 and 130 are mounted upon cylinder 6' with their depressible actuator levers extending into slotted track 60' in interfering relationship with cam followers 64A' and 64'. As pistons 24' and 26' reciprocate within cylinder 6', cam followers 64A' and 64' periodically contact and depress the actuator levers of microswitches 128 and 130, respectively. Similarly, cam followers 66A' and 66' periodically contact and depress the actuator levers of microswitches 124 and 126, respectively. Microswitches 124, 126, 128, and 130 thereby provide a means for sensing the axial position of pistons 24' and 26'.

Figure 7:
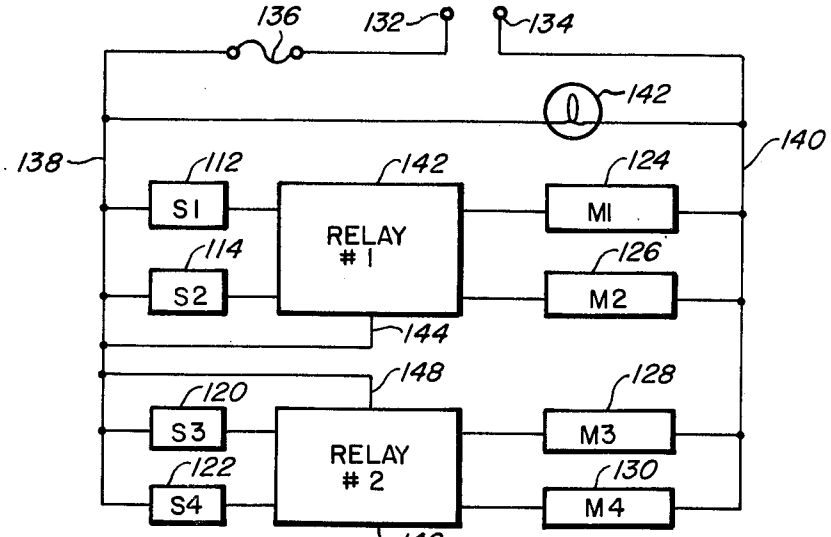
FIG. 7 is a simplified circuit schematic of the components used to sense the axial position of the pistons within the cylinder and to control the operation of the inlet and exhaust valves.

Referring now to the circuit schematic of FIG. 7, solenoid valves 112 and 114 are identified by blocks S1 and S2 respectively, while microswitches 124 and 126 are identified by blocks M1 and M2, respectively. Similarly, solenoid valves 120 and 122 are identified within FIG. 7 by blocks S3 and S4, respectively, while microswitches 128 and 130 are identified by blocks M3 and M4, respectively. Terminals 132 and 134 are coupled to a supply of alternating current which, in the preferred embodiment, has a voltage of 110 volts A.C. Power terminal 132 is coupled to one end of a fuse 136, the opposite end of which is coupled to power supply line 138. Terminal 134 is coupled to a second power supply line 140. An indicator lamp 142 is coupled between power supply lines 138 and 140 for indicating the application of a suitable alternating current voltage to power terminals 132 and 134.

Microswitches 124 and 126 are coupled between power supply line 140 and first and second input terminals of a relay 142. Solenoid valves 112 and 114 are each coupled between power supply line 138 and first and second output terminals of relay 142. Relay 142 is also directly coupled to power supply line 138 by conductor 144. Microswitches 128 and 130 are each coupled between power supply line 140 and first and second input terminals of a second relay 146. Solenoid valves 120 and 122 are each coupled between power supply line 138 and first and second output terminals of relay 146. Relay 146 is also coupled directly to power supply line 138 by a conductor 148. Preferably, relays 142 and 146 are stepping-type relays such as those commercially available from Potter & Brumfield under Model Designation No. KHU 17A11.

The operation of the components shown in the circuit schematic of FIG. 7 will now be described with reference to the engine shown in FIG. 4. Each time piston 24' advances toward end wall 10', cam follower 66A' contacts microswitch 124 (M1) which causes relay 142 to open inlet solenoid valve 112 to admit fluid to expansion chamber 36' and to close inlet solenoid valve 114. Similarly, each time piston 26' advances toward end wall 12', cam follower 66' contacts microswitch 126 which causes relay 142 to open inlet solenoid valve 114 for admitting fluid to expansion chamber 38' and to close inlet solenoid valve 112. In addition, each time piston 24' advances toward end wall 10', cam follower 64A' contacts microswitch 128 (M3) which causes relay 146 to close exhaust solenoid valve 120 and to open exhaust solenoid valve 122 for exhausting fluid from expansion chamber 38'. Similarly, each time piston 26' advances toward end wall 12', cam follower 64' contacts microswitch 130 (M4) which causes relay 146 to close exhaust solenoid valve 122 and to open exhaust solenoid valve 120 for exhausting fluid from expansion chamber 36'.

Those skilled in the art will appreciate that by varying the axial positions of microswitches 124–130, the extent of reciprocal axial movement of pistons 24' and 26' may be adjusted from virtually little movement at all up to a full stroke. As will be explained in further detail below, adjustment of the degree of reciprocal axial movement of pistons 24' and 26' may be used to select the amount of torque imparted to driveshaft 14 by such pistons.

FIG. 8 illustrates one application of the reciprocating engines described above wherein solar energy is utilized to create rotational motion of a driveshaft which might be used, for example, to operate the compressor of a refrigerated air conditioning system or a similar power take-off. Within this application, a refrigerant fluid in liquid form is circulated to solar collector 200 for heating and vaporizing the refrigerant fluid. Solar collector 200 may be a simple flat plate solar collector or a solar concentrator using parabolic reflectors, lenses or the like. The vaporized and pressurized refrigerant leaving solar collector 200 is conducted by conduit 202 to inlet conduits 204 and 206. Unlike the embodiments of the invention shown in FIGS. 1–3 and 4–6 wherein separate inlet and outlet valves are provided at each end of the engine cylinder, the embodiment of the invention shown in FIG. 8 utilizes three-way shuttle valves 208 and 210 to control pressurization and exhaust of the expansion chambers. Shuttle valves 208 and 210 each have a first port which is coupled by conduits 212 and 214, respectively, to one of the two expansion chambers within cylinder 216. Shuttle valves 208 and 210 also each include a second port coupled to inlet conduits 204 and 206 for receiving pressurized refrigerant gas therefrom. In addition, shuttle valves 208 and 210 each include a third port coupled to outlet conduits 218 and 220, respectively, each of which is coupled to an inlet of condenser 222. Shuttle valves 208 and 210 may be controlled by a valve timing mechanism sensitive either to the angular position of the driveshaft 224 or to the axial position of the pistons within cylinder 216 in a manner previously described.

As shown in FIG. 4, when shuttle valve 208 couples high pressure refrigerant conduit 204 to one of the expansion chambers within cylinder 216, shuttle valve 210 is positioned to exhaust refrigerant gas from the opposite expansion chamber. Similarly, to force the pistons within cylinder 216 in the opposite direction from that immediately described above, shuttle valve 208 is rotated clockwise 90° to exhaust refrigerant gas from its associated expansion chamber, while shuttle valve 210 is rotated 90° counter clockwise to pressurize its associated expansion chamber.

Condenser 222 may be of conventional design and sufficiently cools the refrigerant gas contained therein to return the refrigerant to its liquid state. The outlet of condenser 222 is coupled by conduit 225 to pump 228 which pumps the liquid refrigerant into solar collector 200 for repeating the above described cycle.

FIG. 8 also illustrates how an engine constructed according to the teachings of the present invention can be integrated within the electrical utility system of a user whereby the solar powered engine can supply electrical power to the user and to the electrical utility network during daylight hours while utilizing electrical energy supplied by the utility network in order to rotate driveshaft 224 during periods when solar energy is substantially lessened. Referring briefly to FIG. 1, pistons 24 and 26 may be made of a ferrous metal which is magnetically polarized wherein the magnetic dipoles created within pistons 24 and 26 are aligned with one another and with the longitudinal axis of cylinder 216. During periods when solar energy is intense, reciprocation of the magnetically polarized pistons due to the pressurized refrigerant gas causes a varying magnetic field to be created in the vicinity of cylinder 216. A first electrical coil surrounding cylinder 216 is designated by dashed lines 230. The lines of magnetic flux cutting across the windings of coil 230 create an alternating electrical current within coil 230 which alternating current may then be utilized directly by the user to power appliances within his home or building. A second electrical coil, designated in FIG. 4 by solid lines 240 may also surround cylinder 216, and the moving lines of magnetic flux cutting across electrical coil 240 due to the reciprocating movement of the magnetically polarized pistons also induce an alternating electrical current within electrical coil 240. The alternating current created in coil 240 may be coupled to the user's utility meter 242 to supply power back into the utility network, for which the user can receive a credit.

On the other hand, at night and during cloudy days, solar collector 200 may absorb an insufficient amount of energy to adequately power the engine. In this case, electrical coil 240 may be powered by the utility network, and the alternating electro-magnetic field created by electrical coil 240 causes the magnetically polarized pistons within the engine to reciprocate, thereby turning driveshaft 224. During this mode of operation, expansion chambers 36 and 38 are both continuously coupled to a low pressure as by opening a pair of valves (not shown) coupled in parallel with shuttle valves 208 and 210 between conduits 212 and 218 and between conduits 214 and 220, respectively, to override the normal operation of shuttle valves 208 and 210 and to continuously exhaust the expansion chambers.

Referring now to FIG. 9, the outer surface of driveshaft 14 is illustrated as it would appear if unrolled into planar form. Solid curve 244 corresponds physically with guide track 40 formed upon driveshaft 14 (see FIG. 1). The horizontal axis of the figure corresponds to distance in the axial direction, while the vertical axis of the figure corresponds to distance in a rotational direction about the longitudinal axis of driveshaft 14. Within FIG. 9, point 246 represents the end of track 40 closest to end wall 10, while the point designated 248 represents the opposite end of track 40. The angle of the incline of track 244 continuously varies throughout its length. Near point 246, the angle of incline of track 244 is relatively steep, and a relatively large force must be applied by the cam follower riding within the track in order to rotate driveshaft 14. In contrast, adjacent point 248, very little force need be applied to the cam follower riding within track 244 in order to impart rotational movement to driveshaft 14.

By continuously varying the angle of incline of track 244, the torque applied by piston 24 to driveshaft 14 during the power stroke can be maintained relatively constant throughout the entire power stroke. For example, if it is assumed that the volume within expansion chamber 36 when the cam follower is at point 250 is one half of the volume within expansion chamber 36 when the cam follower advances to point 252, then the pressure applied by the pressurized gas within the expansion chamber at point 250 is approximately double the pressure within expansion chamber 36 at point 252. Within FIG. 9, vector 254 designates the force applied by the cam follower at point 250, and vectors 256 and 258 designate the components of such force in the rotational and axial directions, respectively. Similarly, vector 260 designates the force applied at point 252, and vectors 262 and 264 designate the components of such force in the rotational and axial directions. Each of vectors 254 and 260 is tangential to track 244, and force vector 254 is approximately twice the magnitude of force vector 260. Nonetheless, it will be noted that the magnitude of component vector 262 is approximately equal to the magnitude of component vector 256; hence, piston 24 applies the same rotational force upon driveshaft 14 regardless of whether its associated cam follower is at point 250 or at point 252 along track 244.

In addition to providing essentially constant torque throughout each full power stroke, the variably inclined tracks 40 and 42 formed within driveshaft 14 allow the operator to operate the engine for either high torque—low speed or low torque—high speed load driving requirements, as well as any operating condition therebetween. Thus, the disclosed energy transfer device essentially serves as a power transmission. For low speed, high torque load requirements, pistons 24 and 26 are reciprocated only by a fraction of a full stroke for maintaining the cam followers of the ratcheted cam clutches associated with such pistons in the less inclined portions of guide tracks 40 and 42, i.e. maintaining the cam follower associated with ratcheted cam clutch 44 within the portion of guide track 40 closest to end wall 12. In this region, the cam followers benefit from significant leverage forces upon driveshaft 14. However, since only a portion of the guide track is used, the rotational speed of driveshaft 14 is accordingly small. Such low-speed/high-torque operation is particularly useful for such applications as drilling oil wells. As loading requirements call for higher speed and lower torque, the portion of tracks 40 and 42 traversed by the associated cam followers are increased until each power stroke utilizes essentially the entire length of its associated guide track. Referring to the embodiment of the invention shown in FIG. 4, the portion of guide tracks 40 and 42 which are utilized to convert the reciprocating motion of the pistons into rotational motion of the driveshaft can easily be adjusted by varying the placement of microswitches 124, 126, 128, and 130 along the longitudinal axis of cylinder 6'.

Those skilled in the art will now appreciate that an energy transfer device has been described which efficiently converts reciprocating motion to rotational motion. The energy transfer device, through the use of a continuously variable inclined track formed upon the driveshaft, easily allows the input power source to be matched with the torque required by the load. Moreover, when the energy transfer device is constructed in the form of a reciprocating piston driven engine, the continuously variable inclined track formed upon the driveshaft allows the piston to impart a substantially constant torque to the driveshaft throughout the entire drive stroke of the piston. While the invention has been described with reference to a preferred embodiment thereof, the description is for illustrative purposes only and is not to be construed as limiting the scope of the invention. For example, the rotatable driveshaft may be supported outside and adjacent to the engine cylinder, and the ratched cam clutches surrounding the driveshaft may extend laterally from the reciprocating pistons. Various modifications and changes may be made by those skilled in the art without departing from the true spirit and scope of the invention as defined by the apended claims.

I claim:

1. An engine for producing rotational motion, said engine comprising in combination:

(a) a driveshaft having a longitudinal axis;

(b) a cylinder having a longitudinal axis and having first and second ends;

(c) bearing means for rotatably supporting said driveshaft with the longitudinal axis of said driveshaft being coincident to the longitudinal axis of said cylinder and wherein each of said first and second pistons includes a hole through which said driveshaft passes;

(d) a first piston slidably mounted for axial movement within said cylinder proximate the first end thereof;

(e) a second piston slidably mounted for axial movement within said cylinder proximate the second end thereof;

(f) valve means for creating pressure differentials within the first and second ends of said cylinder in order to effect reciprocal sliding movement of said first and second pistons; and (g) cam means coupled to said first and second pistons and coupled to said driveshaft for converting reciprocating movement of said first and second pistons into unidirectional rotational movement of said driveshaft, said cam means including a helical track and follower adapted to engage the helical track, said helical track being a continuous track comprising a plurality of portions defining an axial vector parallel to the driveshaft axis and a rotational vector perpendicular to and extending circumferentially about said driveshaft axis, the ratio of the rotational vector to the axial vector for succeeding segments varying along said generally helical track for permitting said first and second pistons to exert a substantially constant torque upon the driveshaft during said axial movement with the cylinder;

(h) means for substantially preventing rotational motion of said first and second pistons comprising at least one linear track formed within said cylinder and cam follower means coupled to at least one of said first and second pistons and captively engaged by said linear track; and (i) wherein said valve means admits a fluid alternately into the first and second ends of said cylinder in order to alternately pressurize the first and second ends of said cylinder and to force the first and second pistons, respectively, to move toward the second and first ends of said cylinder, respectively, and wherein said valve means exhausts fluid alternately from the first and second ends of said cylinder for allowing the first and second pistons, respectively to freely move toward the first and second ends of said cylinder, respectively, and wherein said valve means is responsive to the angular position of said driveshaft for controlling the admission and exhaust of fluid to and from, respectively, the first and second ends of said cylinder, and a cam member rigidly attached to said driveshaft with said cam member including a cam face which is inclined relative to said driveshaft axis and said cam face abutting against said valve means for actuating said valve means depending upon the angular position of said driveshaft.

2. An engine as recited by claim 1 wherein the hole within each of said first and second pistons is bounded by a bearing surface for allowing said pistons to slide with respect to said driveshaft and for allowing said driveshaft to rotate with respect to said first and second pistons.

3. An engine as recited by claim 1 wherein said engine is of the internal combustion type and wherein said fluid admitted to the first and second ends of said cylinder is a combustible fuel.

4. An engine as recited by claim 1 wherein said fluid admitted to the first and second ends of said cylinder is a pressurized fluid.

5. An engine as recited by claim 1 wherein at least one of said first and second pistons is magnetically polarized, said engine further including an electrically conductive coil proximate said cylinder for conducting an alternating current and for surrounding said magnetically polarized piston with a varying electromagnetic field for causing said first and second pistons to reciprocate within said cylinder.

6. An engine as recited by claim 1 wherein said driveshaft has first and second helical tracks formed thereon, said first and second helical tracks extending in rotational directions opposite to one another, and wherein said cam means includes first and second ratcheted cam clutches, said first ratched cam clutch being secured to said first piston and including a first follower for engaging said first track, said first follower being rotatable about the longitudinal axis of said driveshaft relative to said first piston in a first direction only, said second ratched cam clutch being secured to said second piston and including a second follower for engaging said second track, said second follower also being rotatable about the longitudinal axis of said driveshaft relative to said second piston in said first direction only.

7. An engine as recited by claim 6 further including means for rigidly securing said first and second pistons to one another.

8. An engine as recited by claim 6 wherein each segment of said first and second helical tracks formed upon said driveshaft has a predetermined axial length and a corresponding angle of rotation about the longitudinal axis of said driveshaft, and wherein the ratio of said angle of rotation to said axial length varies along each of said first and second helical tracks.

9. An engine as recited by claim 8 wherein the rotio of said angle of rotation to said axial length for said first track continuously decreases from the end of said first track closest to the first end of said cylinder to the opposite end thereof, and wherein the ratio of said angle of rotation to said axial length for said second track continuously decreases from the end of said second track closest to the second end of said cylinder to the opposite end thereof.

10. An energy transfer device for converting reciprocal motion to rotational motion, said energy transfer device comprising in combination:

(a) a cylinder having a first longitudinal axis;

(b) a rotatable driveshaft having a second longitudinal axis coincident to the first longitudinal axis, said driveshaft having at least one generally helical groove formed thereon with succeeding portions of said groove having varying angles of inclination relative to the second axis;

(c) at least one piston slidably mounted within said cylinder and wherein said piston includes a hole through which said driveshaft passes, means for substantially preventing rotational motion of said piston comprising at least one linear track formed within said cylinder and cam follower means coupled to said piston and captively engaged by said linear track, (d) a ratcheted cam clutch secured to said piston and including a follower for engaging said track, said follower being rotatable about the second longitudinal axis relative to said piston in a first direction only for converting reciprocal sliding motion of said piston to rotational motion of said driveshaft; and (e) said succeeding portions of said generally helical groove having a predetermined axial length and a corresponding angle of rotation relative to said second longitudinal axis, the ratio of said angle of rotation to said axial length varying along said generally helical track for causing the pistion to exert a substantially constant rotational force on the dirveshaft as the piston slides within the cylinder; and (f) valve means for selectively admitting a fluid into said cylinder for applying pressure to said piston to effect sliding motion thereof in a first direction, said valve means also selectively exhausting fluid from said cylinder to allow sliding motion of said piston in a second direction opposite to said first direction, wherein said valve means is responsive to the angular position of said driveshaft for controlling the admission and exhaust of fluid to and from, respectively, said cylinder, and a cam member rigidly attached to said driveshaft with said cam member including a cam face which is inclined relative to said second longitudinal axis and said cam face abutting against said valve means for actuating said valve means depending upon the angular position of said driveshaft.

11. An energy transfer device as recited by claim 10 wherein the hole within said piston is bounded by a bearing surface for allowing said piston to slide with respect to said driveshaft and for allowing said driveshaft to rotate with respect to said piston.

12. An energy transfer device as recited by claim 10 wherein said fluid admitted to said cylinder is a combustible fuel.

13. An energy transfer device as recited by claim 10 wherein said fluid admitted to said cylinder is a pressurized fluid.

14. An energy transfer device as recited by claim 10 wherein said piston is magnetically polarized, said energy transfer device further including an electrically conductive coil proximate said cylinder for conducting an alternating current and for surrounding said piston with a varying electromagnetic field in order to cause said piston to reciprocate within said cylinder.

* * * * *